US005827139A

United States Patent [19]

DeCanio et al.

[11] Patent Number: 5,827,139

[45] Date of Patent: Oct. 27, 1998

[54] ROLLER HOCKEY NET FASTENING DEVICE

[75] Inventors: Paul Joseph DeCanio, Brentwood; Gary Eddie DeCanio, Centereach, both of N.Y.

[73] Assignee: Paul J. DeCanio, Brentwood, N.Y.

[21] Appl. No.: 795,021

[22] Filed: Feb. 4, 1997

[51] Int. Cl.[6] ..... A63B 63/00

[52] U.S. Cl. ..... 473/478

[58] Field of Search ..... 473/478

[56] References Cited

U.S. PATENT DOCUMENTS 4,664,384 5/1987 Solla ..... 473/478

*Primary Examiner*—William H. Grieb

[57] ABSTRACT

A device for attaching a roller hockey net to a desired location. The device includes a body structure having a concave shoe member on one end and a concave shoe member on the other end which the quick ties are installed through and a plate member there between, the plate member having on its bottom surface male VELCRO thereon which engages with the female VELCRO which is attached to the roller surface. The body structure may be made of a metalic material, the VELCRO is of the industrial type and the quick ties are the plastic type.

2 Claims, 1 Drawing Sheet

ROLLER HOCKEY NET FASTENING DEVICE

BACKGROUND OF THE INVENTION

1. Field of the invention

The invention relates generally to a device that allows a roller hockey net to be removably fastened to the roller rink floor in a desired position.

2. Description of the prior art

Roller hockey nets currently in use have no fastening means to hold the nets in the proper position which during play tend to become dislodged out of position and cause a play stoppage which will result in a delay of the game this invention eliminates this problem.

SUMMARY OF THE INVENTION

The invention relates generally to a device to allow a roller hockey net to be removably fastened to a desired location. It comprises a means for attaching the invention to the hockey net, a removably fastening means to the roller rink skating surface.

It is an object of this invention to provide an inexpensive device which will allow more efficient use of a roller hockey net, which will make the game more safe and enjoyable.

DESCRIPTION OF THE PREFERRED EMBODIMENT

Figure 1:
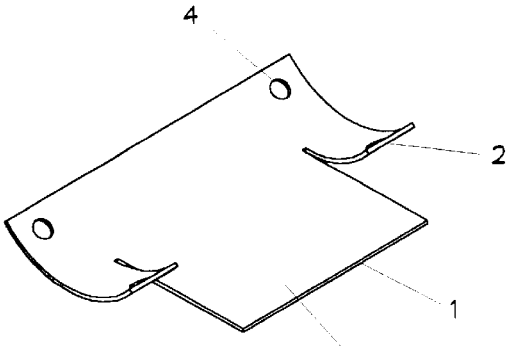
FIG. 1 is a elevation view showing an embodiment of the Roller Hockey Net Fastening Device.
Figure 2:
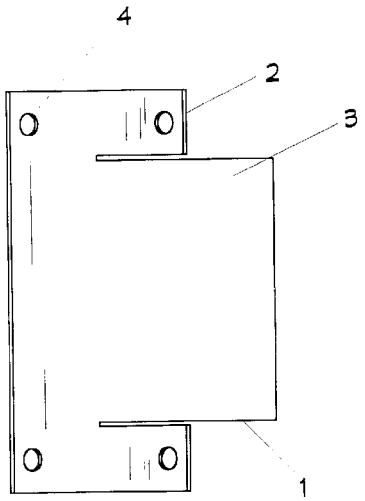
FIG. 2 is a top view showing an embodiment of the Roller Hockey Net Fastening Device.
Figure 4:
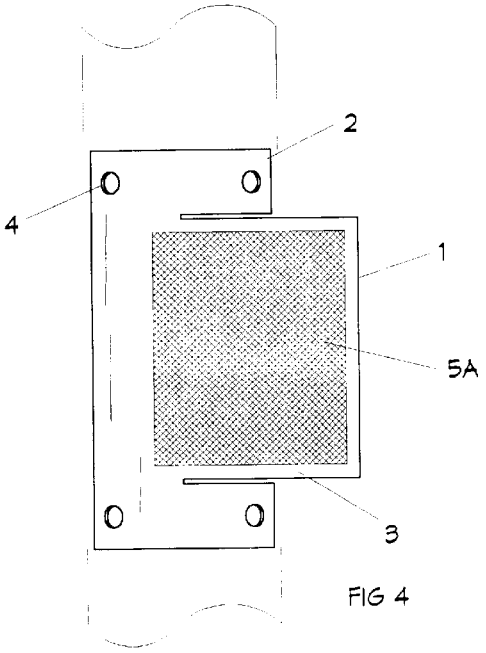
FIG. 4 is a bottom view showing an embodiment of the Roller Hockey Net Fastening Device.
Figure 3:
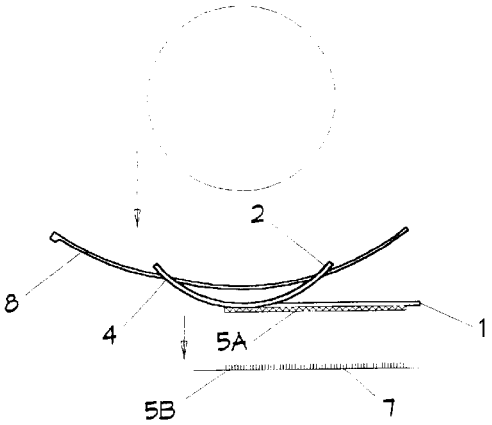
FIG. 3 is a side view showing an embodiment of the Roller Hockey Net Fastening Device.
Figure 5:
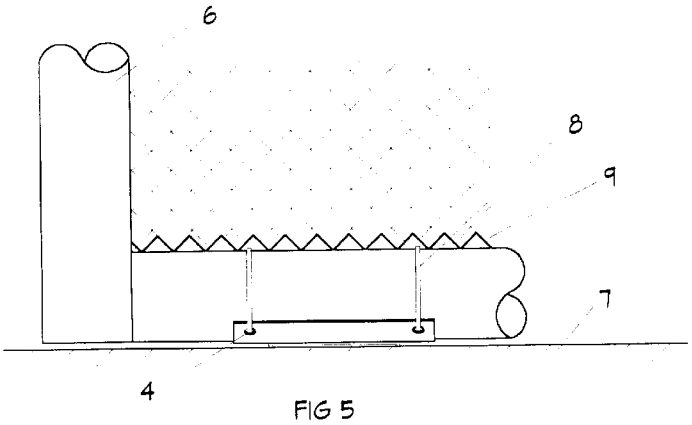
FIG. 5 is a side view showing another embodiment of the Roller Hockey Net Fastening Device installed on the roller hockey net.
Figure 6:
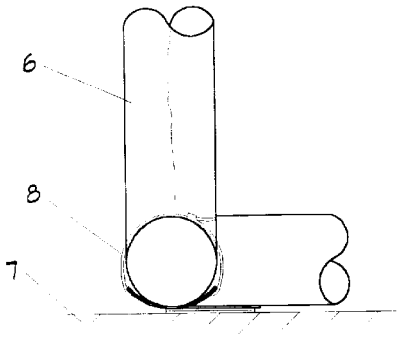
FIG. 6 is a side view showing yet another embodiment of the Roller Hockey Net Fastening Device installed on the roller hockey net.

Referring to the FIGS. 1,2,3,4,5 and 6 an embodiment of the invention is shown in which the Roller Hockey Net Fastening Device is fastened to the hockey net 6 and the roller surface 7. The fastening means is shown in this embodiment as having the elements of a body structure 1, concave shoe members 2, plate member 3, quick ties 8, male VELCRO 5A and female VELCRO 5B.

In this embodiment the body structure 1 has concave shoe members 2 which encompass the hockey net 6 a third of the cicumferential surface and fastened by means of quick ties 8 and a plate member 3 which has male VELCRO 5A permanently attached there to means for removably fastening the hockey net to the female VELCRO 5B which is permanently attached to a desired location on the roller surface 7.

The embodiment is fastened to the roller hockey net 6 by lifting the hockey net 6 and putting the body structure 1 on the bottom circumferential surface of the hockey net 6 so that the concave shoe members 2 encompass the hockey net 6 then the quick ties 8 are put through the tie holes 4 and the netting fastener 9 and completely encompass the hockey net 6 and completely tightened, then the hockey net 6 is placed in the desired location by mating the male VELCRO 5A to the female VELCRO 5B which is permanently fastened to the roller surface 7. The VELCRO 5A and 5B would allow the hockey net 6 to become lodged for the safety of the hockey players.

Although one detailed embodiment of the invention is illustrated in the drawings and previously described in detail this invention contemplates any configuration and design of components which will accomplish the equivalent result.

What is claimed is:

1. A device for removably fastening a roller hockey net to a desired location which comprises:

A. A body structure including part of the first end surface of a first concave shoe member which is perpendicular to the length of the body structure and is adjacent to a second concave shoe member which is perpendicular to the length of the body structure, which there between the concave shoe members is the plate member which on the bottom surface has male VELCRO permanently attached to there on, B. said concave shoe members comprise a U like shaped element having a diameter which is larger then that of the hockey net and having holes located at the top of the concave shoe members which allows the quick ties to protrude through to allow the device to be fastened to the hockey net, C. said plate member comprises a rectangular shaped element having the said concave shoe member part of the first end surface and the said concave shoe member on the second end surface, which on the opposite side of the plate member is the said male VELCRO permanently attached there on which allows the device to be removably fastened to the female VELCRO which is permanently attached to the roller surface, D. whereby the device is attached to the hockey net by engagement of the said concave shoe members with the hockey net bottom surface which the said quick ties are tightened with a securing force, the said plate member bottom surface which has the said male VELCRO permanently attached is installed to the desired location by engagement of the said male VELCRO and female VELCRO which is permanently attached to the roller surface to a desired location.

2. A device as recited in claim 1, wherein the body structure is made of a metalic material and wherein said male and female VELCRO is of the industrial grade and wherein the quick ties are of the plastic type.

* * * * *